US006811525B2

(12) United States Patent
Culpepper

(10) Patent No.: US 6,811,525 B2
(45) Date of Patent: Nov. 2, 2004

(54) METHOD OF LOADING CARTONS

(75) Inventor: Will L. Culpepper, Atlanta, GA (US)

(73) Assignee: MeadWestvaco Packaging Systems, LLC, Stampford, CT (US)

( * ) Notice: Subject to any disclaimer, the term of this patent is extended or adjusted under 35 U.S.C. 154(b) by 0 days.

(21) Appl. No.: 09/880,198

(22) Filed: Jun. 13, 2001

(65) Prior Publication Data

US 2002/0193218 A1 Dec. 19, 2002

(51) Int. Cl.[7] ..... B31B 1/88
(52) U.S. Cl. ..... 493/55; 493/71
(58) Field of Search ..... 493/55, 71; 53/48.7, 53/48.8, 48.1, 49, 48.5, 398

(56) References Cited

U.S. PATENT DOCUMENTS 3,701,230 A * 10/1972 Gentry ..... 53/48.7
3,990,572 A * 11/1976 Fishback ..... 198/458
5,019,029 A * 5/1991 Calvert ..... 493/315
5,212,930 A * 5/1993 Raudat ..... 53/263
5,495,703 A * 3/1996 Kruit et al. ..... 53/398
5,613,828 A * 3/1997 Haddow et al. ..... 414/798.9
5,755,075 A * 5/1998 Culpepper ..... 53/157
6,076,331 A * 6/2000 Granbakken et al. ..... 53/398

* cited by examiner

*Primary Examiner*—Eugene Kim
(74) *Attorney, Agent, or Firm*—Thomas A. Boshinski

(57) ABSTRACT

Substantially tubular, or sleeve-type, cartons each with an end opening having a width less than a pitch of flight bars of a packaging machine but having a combined end opening equal to the pitch of the packaging machine are erected and placed between the flight bars. In one embodiment, the cartons are detachable affixed to one another. In another embodiment, the cartons are detachable affixed to one another in collapsed condition such that the composite collapsed carton formed thereby has dimensions substantially similar to a single carton loadable on the machine.

4 Claims, 6 Drawing Sheets

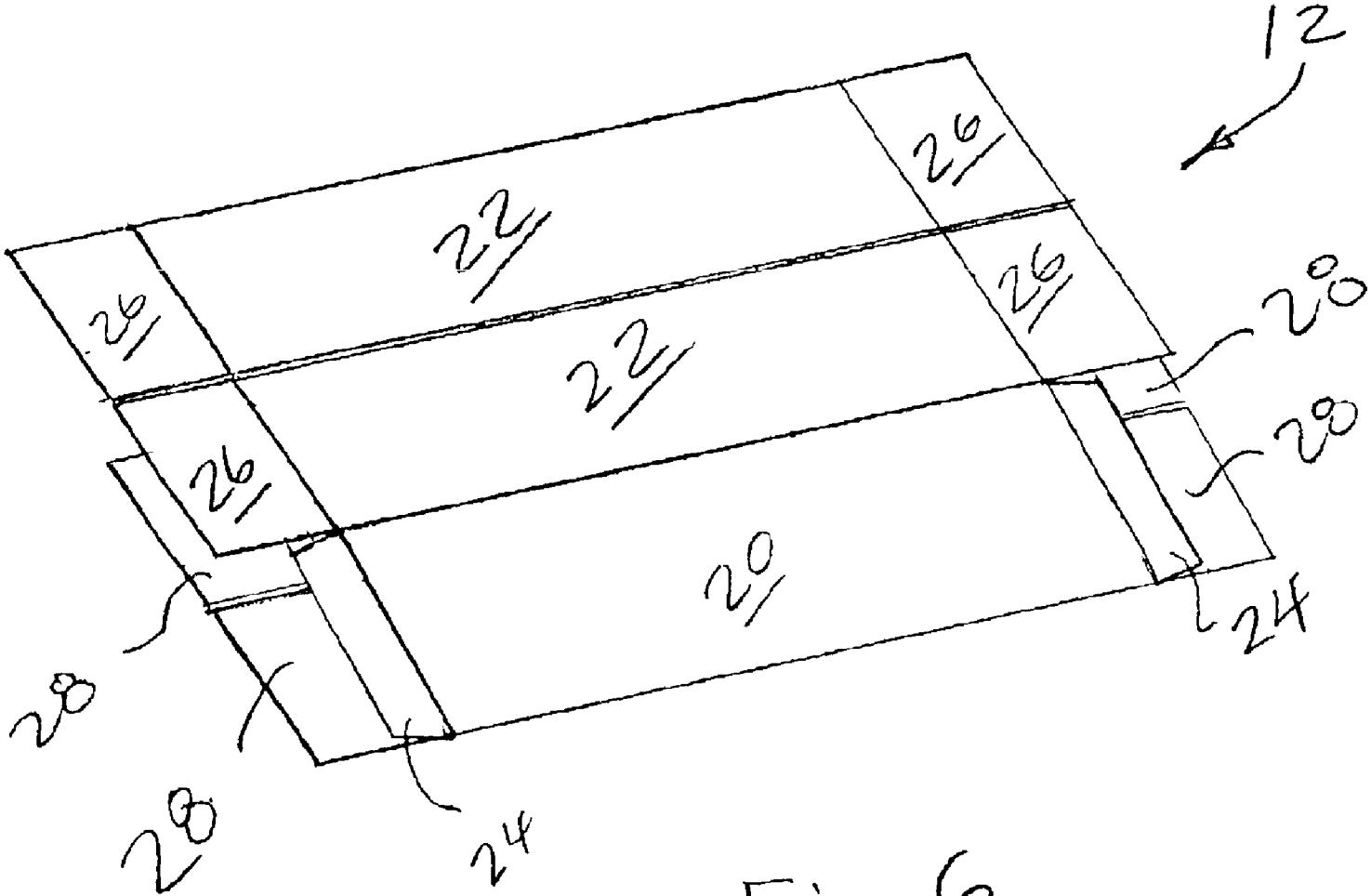
12
22
22
22

METHOD OF LOADING CARTONS

CROSS-REFERENCE TO RELATED APPLICATIONS (Not applicable)

STATEMENT REGARDING FEDERALLY-SPONSORED RESEARCH AND DEVELOPMENT (Not applicable)

TECHNICAL FIELD OF THE INVENTION

The invention relates to cartons and packaging machines for loading articles into cartons, and more specifically to a method for loading substantially tubular-shaped, or sleeve-type, cartons in a packaging machine having a pitch greater than the width of the carton opening.

BACKGROUND OF THE INVENTION

Substantially tubular-shaped cartons (also called sleeve-type cartons) are often used for packaging multiples of articles such as beverage cans or bottles. Such cartons are often packaged in a continuous-motion packaging machine wherein a continuous stream of articles such as beverage cans is loaded into one or more ends of a continuous stream of open-ended cartons. In such a packaging machine, flight bars typically transport the open-ended cartons. U.S. Pat. No. 3,990,572 to Fishback and U.S. Pat. No. 5,019,029 to Calvert are examples of the packaging methodology described.

The flight bars in a continuous-motion packaging machine are typically transported on an endless chain and spaced apart at intervals corresponding to the width of the opening of cartons that are to be loaded. The spacing between flight bars is often referred to as the "pitch" of the flight bars or the machine. FIG. 1 is a side elevational schematic illustration of the pitch of a flight bar arrangement. In the illustration, cartons 2 positioned between flight bars 6 and supported upon a surface 4 are transported by the flight bars in direction "D" along the support surface. The pitch of the apparatus is denoted by the letter "P" and is illustrated as the distance between flight bars, and, in turn, is based upon the width of the carton 2 opening shown.

As stated above, the pitch of a packaging machine is related to the width of the open end of a carton to be loaded. The width of a carton is, in turn, related to the width of articles, such as beverage cans or bottles, that the carton is designed to hold. The overall width of a carton is typically a multiple of the widths of individual articles to be packaged. For beverage cans or bottles, the width is the diameter of the substantially cylindrical portion of the article. In a packaging operation, it is often desirable to produce packages of different configurations or packages that contain different numbers of articles. In these instances, particularly when a smaller package is desired, it is often necessary to use a carton that has a narrower width at its open end.

A carton having a widthwise-narrower open end, because it is a narrower carton, requires a lesser pitch for flight bars. The problem is illustrated in FIG. 2, which is a schematic illustration showing a smaller carton in a machine set at a greater pitch. The end opening of the carton 10 has a width "w" that is less than the pitch P of the machine. The carton 10 does not receive adequate support because it is engaged (if at all) by only one of the flight bars. Thus, in general, the packaging machine must be modified to adequately handle the carton 10 of smaller opening width.

A problem in attempting to modify a packaging machine to accommodate a different carton than the machine is set for is that is that it is generally difficult to modify a packaging machine, if possible at all, to change its pitch. When a change-over (or conversion) to a different pitch is possible, the procedure is typically time-consuming, tedious and costly. The change-over operation is typically costly not only because of labor and parts but also due to lost production because packages are not produced during the conversion process. Even after the necessary parts have been changed, the machine may require extensive adjustments to operate properly at a different pitch Thus, it can be appreciated that it would be useful to have a method for packaging a carton whose opening for loading is less than the pitch of the packaging machine.

BRIEF SUMMARY OF THE INVENTION

In accordance with a preferred embodiment of the invention, substantially tubular, or sleeve-type, cartons each with an end opening having a width less than a pitch of flight bars of a packaging machine but having a combined end opening equal to the pitch of the packaging machine are erected and placed between the flight bars.

In accordance with another aspect of a preferred embodiment of the invention, the cartons are detachably affixed to one another.

In accordance with a further aspect of a preferred embodiment of the invention, the cartons are detachably affixed to one another in collapsed condition such that the composite collapsed carton formed thereby has dimensions substantially similar to a single carton loadable on the machine.

Other advantages and objects of the present invention will be apparent from the following description, the accompanying drawings, and the appended claims.

BRIEF DESCRIPTION OF THE SEVERAL VIEWS OF THE DRAWINGS

FIG. 6 is a perspective illustration of the composite carton of FIG. 5 in substantially collapsed condition.

DETAILED DESCRIPTION OF THE INVENTION

Figure 1:
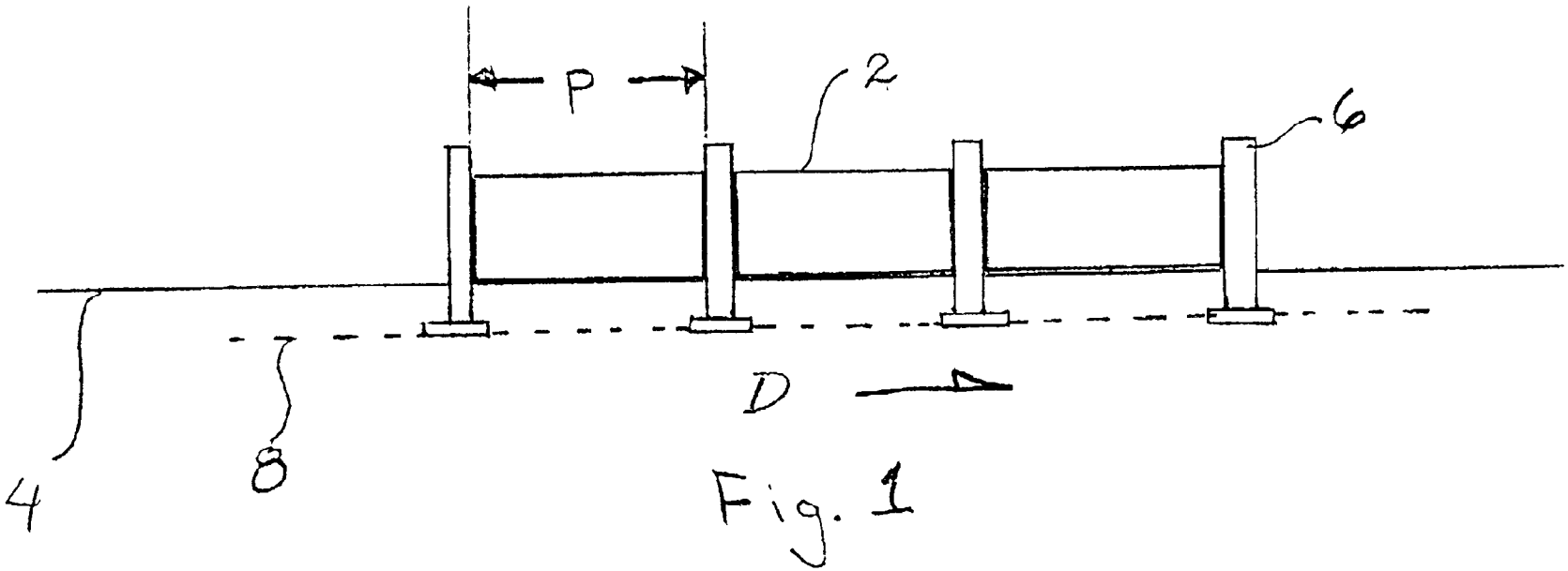
FIG. 1 is a schematic elevational view of a flight bar arrangement in a packaging machine illustrating the environment in which the present invention is applicable.
Figure 2:
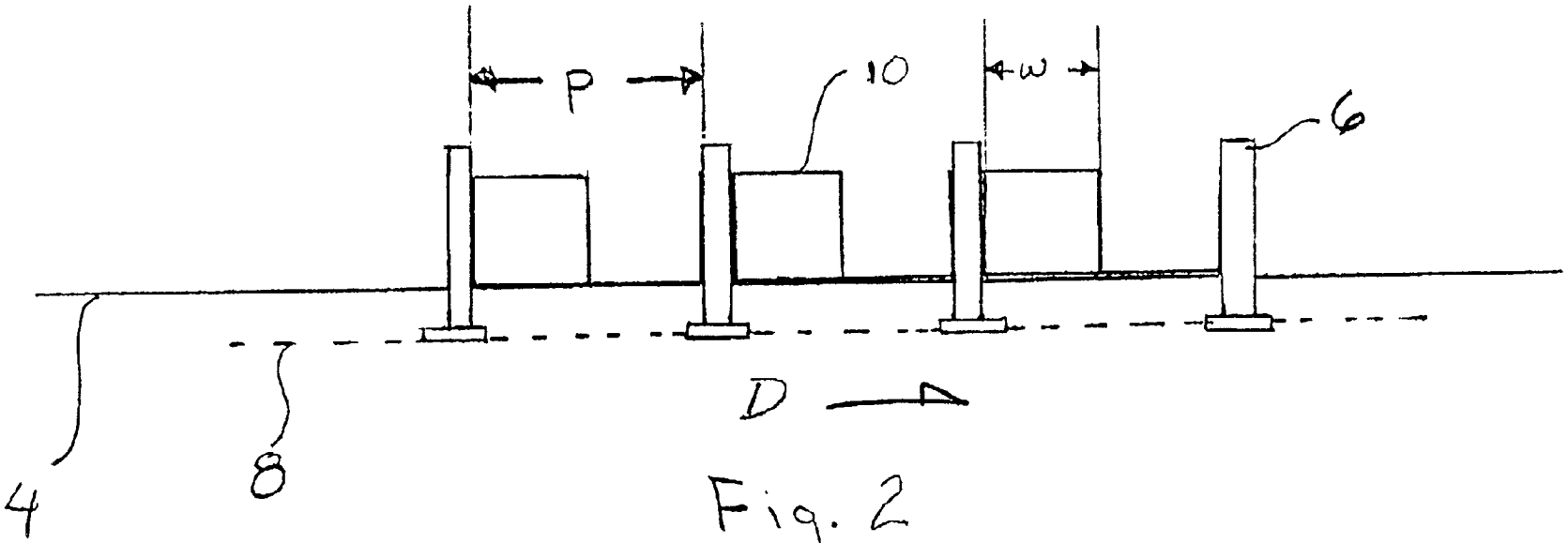
FIG. 2 is a schematic elevational view of a flight bar arrangement in the packaging machine of FIG. 1 illustrating the problem of a carton having an end opening of a width less than the pitch of the flight bars.

Throughout the drawings, the same reference numerals are used to denote the same or like features of the invention.

Figure 3:
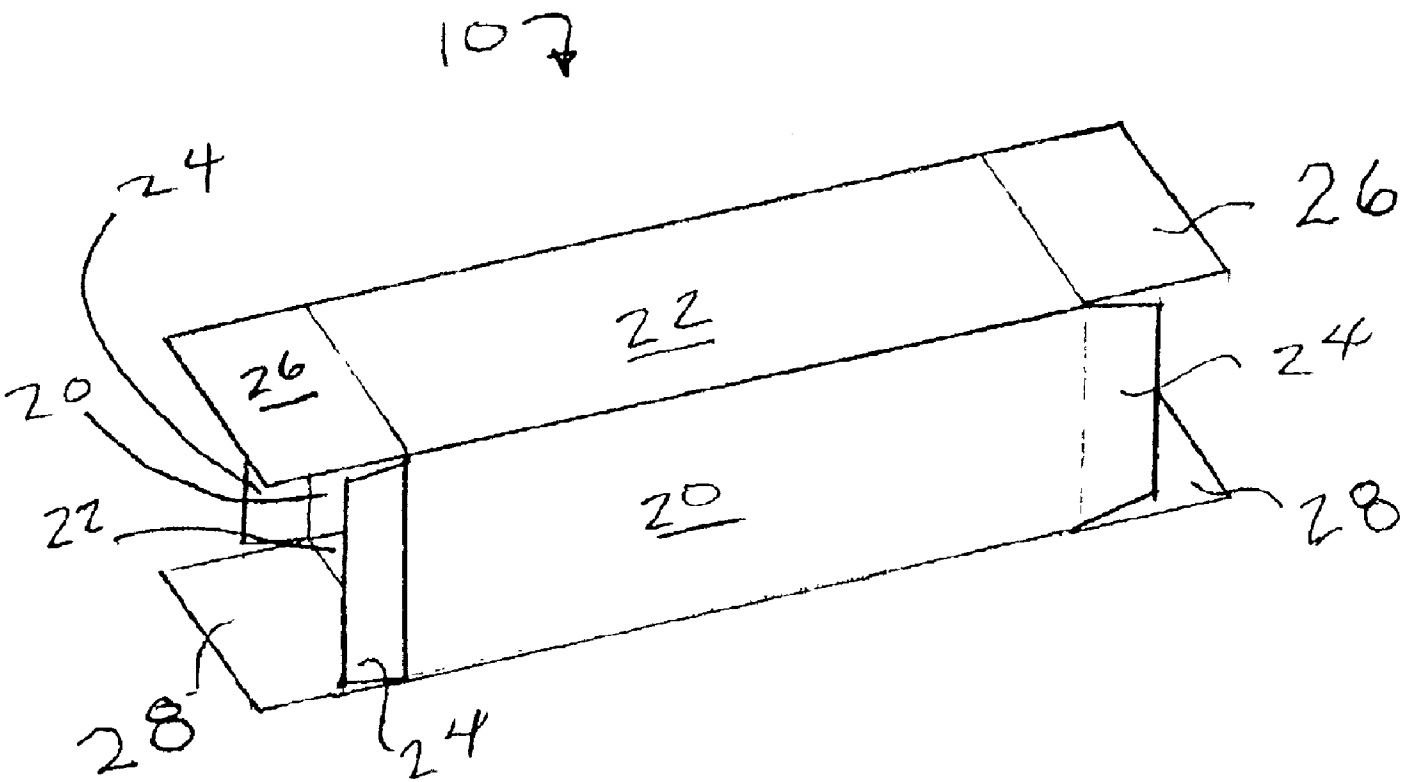
FIG. 3 is a perspective illustration of a carton used in a preferred embodiment of the invention.

Referring first to FIG. 3, therein is illustrated in perspective view a carton 10 having an end opening of width w which carton 10 is suitable for use in accordance with the teachings of a preferred embodiment of the invention. The carton 10 has opposing side walls 20 and opposing upper and lower walls 22. Each end wall is formed predominantly by an upper end flap 26 and a lower end flap 28 attached to the upper and lower walls, respectively. Each end wall is completed by side flaps 24 attached to the side walls 20.

Figure 4:
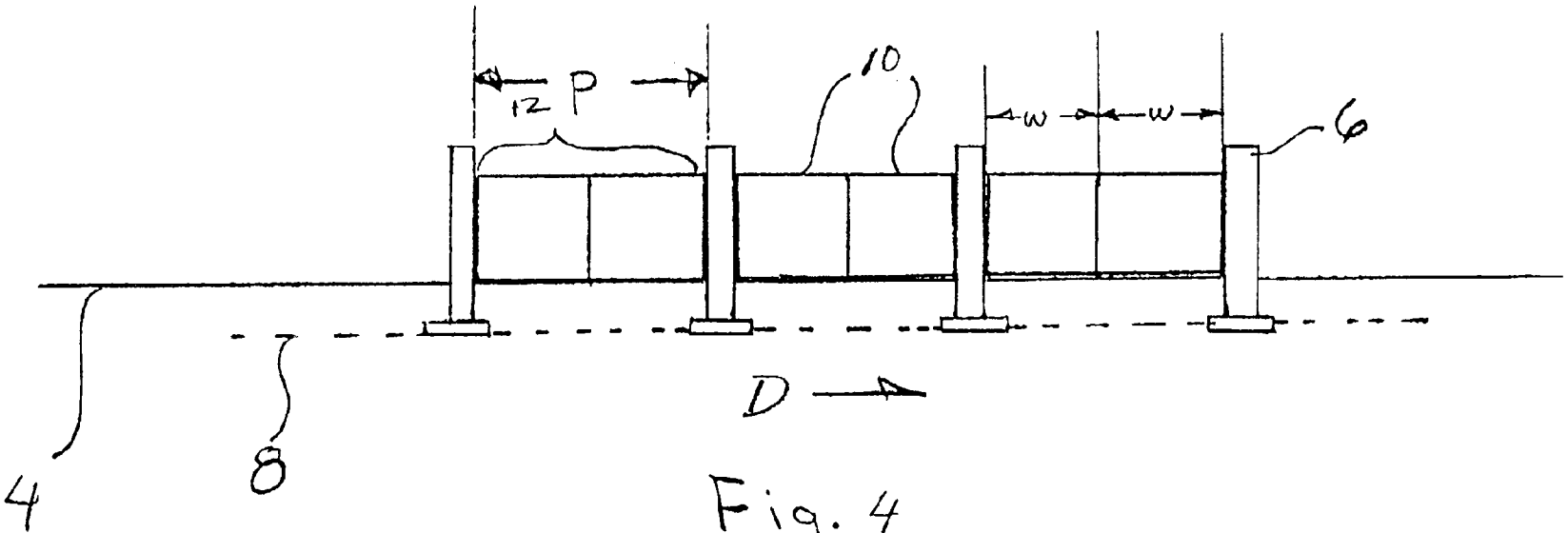
FIG. 4 is a schematic elevational illustration of the carton of FIG. 3 in a packaging machine environment in accordance with the teachings of a preferred embodiment of the invention.

Referring now to FIG. 4, which is an elevational schematic illustration cartons 10, 12 engaged by flight bars 6 in a machine in accordance with a the preferred embodiment of the invention, the width w of the opening of the end of the carton is clearly shown to be less than the pitch P of the machine. In the embodiment of the invention illustrated, the pitch P of the packaging machine is twice the width w. Stated in another manner, the width w of the end opening is one-half of the pitch P. Therefore, two tubular, or sleeve-type, cartons 10 are positioned between the flight bars 6 for loading.

Figure 5:
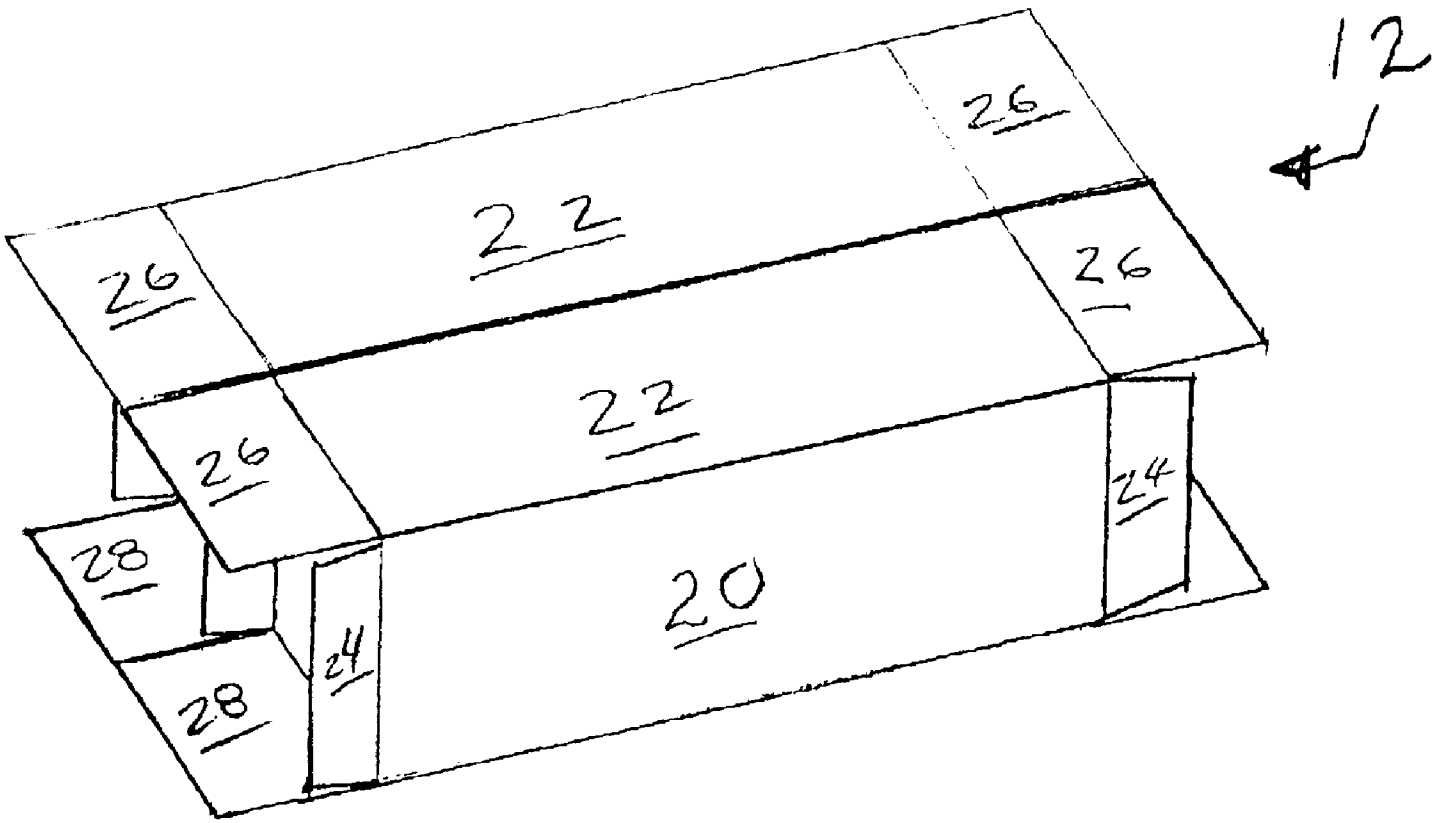
FIG. 5 is a perspective illustration of a composite carton in accordance with the teachings of a preferred embodiment of the invention.

One method of disposing the cartons 10 between pairs of flight bars 6 is by automatically feeding individual cartons 10 from a hopper. This requires that the cartons 10 be fed at a rate that is a multiple of the rate that single cartons (such as those cartons 2 depicted in FIG. 1) are fed into the flight bars 6. A preferred method of disposing cartons 10 between flight bars 6 in accordance with the teachings of the invention is to create a composite carton 12 as depicted in FIG. 5. The composite carton 12 is formed from multiples of the individual cartons 10 sufficient to occupy the pitch P between flight bars 6. In the preferred embodiment illustrated, two cartons 10 of an opening width w equal to one-half P form a composite carton 12 (also shown in FIG. 4). The composite carton 12 may be formed by detachably affixing cartons to one another at their side walls 20. A suitable method of detachably affixing cartons 10 to one another is to adhere them together with an adhesive.

As illustrated in FIG. 6, the composite carton 12 is collapsible as if a single carton having the joint dimensions of the single cartons 10. The composite cartons 12 are loadable into the same hopper as the standard-sized cartons 2 depicted in FIG. 1. The packaging machine is able to handle the composite carton 12 as if it was a single carton 2 shown in FIG. 1. The machine is more or less deceived into believing it is packaging cartons of the dimensions (particularly pitch P) for which the machine is set up. In fact, the machine does not perform any differently.

In the manner described above, a packaging machine is able to create packages of a smaller or different configuration than that which the machine is set up for. For example, the carton depicted in FIG. 1 may be sized to receive four articles across its end width while the carton 10 of smaller configuration would accommodate 2 cans wide. Because the composite carton 12 is formed in a manner wherein the individual cartons 10 are detachable from one another, the individual packaged cartons 10 are easily separated after packaging.

As an additional benefit, the invention enables the packaging machine to be run at an optimum speed, continuously packaging the maximum number of articles (cans or bottles) between pairs of flight bars.

Modifications may be made in the foregoing without departing from the scope and spirit of the claimed invention. For example, the teachings of the invention encompass cartons having an end opening that is one-third the dimension of the pitch P such that three cartons are detachably affixed to one another to form a composite carton. Further, in the preferred embodiments discussed above the cartons 10 that form the composite carton 12 have end openings of equal width. However, the invention also encompasses a composite carton formed from individual cartons of different widths but wherein the composite width equals the pitch of the machine.

What is claimed is:

1. A method of loading cartons in a packaging machine, comprising:

providing a plurality of cartons, each of said plurality of cartons comprising an end opening having a width less than a pitch of flight bars of the packaging machine;

detachably affixing the plurality of cartons to one another, such that the combined end opening width of the detachably affixed cartons are equal to the pitch of the packaging machine;

facilitating placement of the plurality of detachably affixed cartons between the flight bars, wherein said plurality of detachably affixed cartons are provided in a collapsed condition prior to being placed in the packaging machine, such that they are manipulated by the packaging machine for placement between the flight bars as if they are a unitary carton; and detaching the plurality of cartons from one another after the plurality of cartons have been loaded.

2. The method of claim 1, wherein said plurality of cartons have end openings of equal width.

3. The method of claim 1, wherein said plurality of cartons are detachably affixed to one another by an adhesive.

4. The method of claim 1, wherein the plurality of cartons are detachably affixed to one another by an adhesive.

* * * * *